US006808175B1

(12) United States Patent
Gleeson

(10) Patent No.: US 6,808,175 B1
(45) Date of Patent: Oct. 26, 2004

(54) FOOTBALL BOLA GAME

(76) Inventor: Bradford J. Gleeson, 58 Whitehaven La., St. Charles, MO (US) 63304

( * ) Notice: Subject to any disclaimer, the term of this patent is extended or adjusted under 35 U.S.C. 154(b) by 0 days.

(21) Appl. No.: 10/795,718

(22) Filed: Mar. 8, 2004

(51) Int. Cl.[7] ..... A63B 63/00
(52) U.S. Cl. ..... 273/343; 473/575; 473/576
(58) Field of Search ..... 273/343, 401, 273/407; 473/575, 576, 514, 476, 477; D21/301, 436, 465, 466, 712

(56) References Cited

U.S. PATENT DOCUMENTS 2,797,924 A * 7/1957 Stewart ..... 273/343
3,685,826 A * 8/1972 Lehman ..... 273/343
3,701,531 A 10/1972 Bowers
3,717,348 A 2/1973 Bowers
5,165,694 A * 11/1992 Kraushaar ..... 273/343
5,294,129 A * 3/1994 Brown ..... 473/514
6,220,976 B1 * 4/2001 Kaiser et al. ..... 473/476
6,308,956 B1 * 10/2001 Reid ..... 273/343
2002/0084588 A1 7/2002 Lynch
2002/0125644 A1 9/2002 Knudson
2004/0135318 A1 * 7/2004 Long et al. ..... 273/343

* cited by examiner

*Primary Examiner*—Raleigh W. Chiu
(74) *Attorney, Agent, or Firm*—Mark S. Hubert

(57) ABSTRACT

A portable football inspired bolo throwing game of skill wherein two tethered miniature footballs are tossed onto a runged stand bearing resemblance to a football goalpost. The base of the runged stand accepts a placard with the name, insignia or logo of well known college or professional teams. In this way the owner can display his loyalty. The miniature footballs are similarly adorned. The ratio of the dimensions of the game pieces lead to a lively game where luck plays a greater role than does skill.

20 Claims, 2 Drawing Sheets

FOOTBALL BOLA GAME

BACKGROUND OF THE INVENTION

The present invention relates to a portable object throwing game of skill, and more particularly for a bolo tossing game with a football motif.

Object tossing games, including bolos as the tossed objects, have been utilized in the gamming and amusement industry for decades, possibly centuries. Although they all vary in design, generally they utilize a limbed or runged support that is capable of catching a bolo. Here, players toss a form of bolo and attempt to have its final resting position conform to the area of highest scoring on a runged support designed to be similar in appearance to a football goalpost.

As is true of most sports and games, their popularity is related to where they can be played, the ease of play and the enjoyment that playing can bring. This present invention is designed to be quickly assembled and utilized outdoors at such locations as where football tailgate parties may occur. Where better place to find people who a re prime candidates to play and purchase a game bearing a football motif? Its unique ratio of bolo size and tether length to goalpost dimensions, result in a lively game wherein the bolo randomly "jumps" about the goalpost rungs and uprights. This added element of unpredictability in the game tends to minimize the skill aspect, making the game attractive to novices, who are the targeted audience and consumers.

Simply stated, the time has come for a new design of throwing games.

SUMMARY OF THE INVENTION

In accordance with the invention, an object of the present invention is to provide an improved bolo tossing game of skill with a football motif that can be adapted to bear the insignia, logo or name of the owner's favorite team.

It is yet a further object of this invention to provide an object tossing game of skill that utilizes a bolo that can be ensnared on a post having upright and horizontal bars.

It is another object of this invention to provide an improved outdoor amusement device that can be quickly and easily assembled and that is capable of enjoyment by players of all ages.

It is a further object of this invention to provide a recreational apparatus that utilizes two miniature footballs joined by a flaccid resilient tether that are thrown about the upright and horizontal bars of a post designed to be similar in appearance to a football goalpost.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

The preferred embodiment of the present invention is provided in a set of miniaturized footballs joined together by a flexible, resilient tether to form a bolo that is tossed at a post configured with multiple horizontal and vertical bars to ensnare the bolo.

Figure 8:
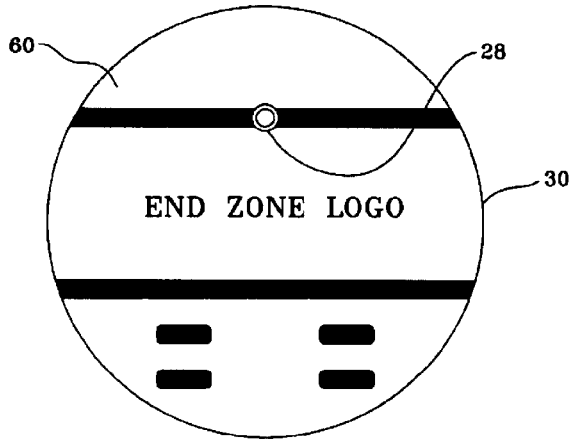
FIG. 8 is a top view of the base support for the goalpost.
Figure 1:
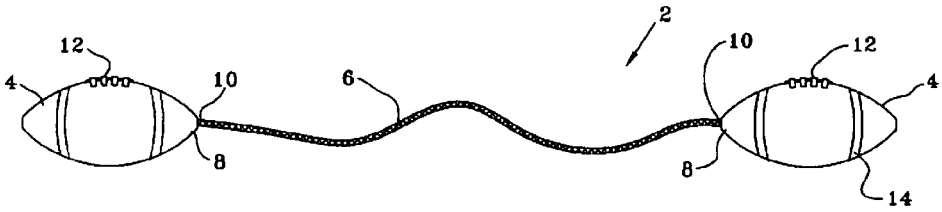
FIG. 1 is a perspective view of a football bolo.
Figure 2:
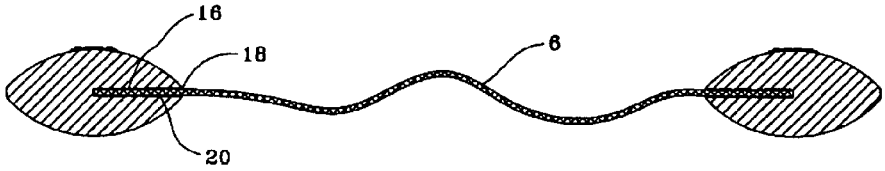
FIG. 2 is a cross sectional view of a football bolo.
Figure 6:
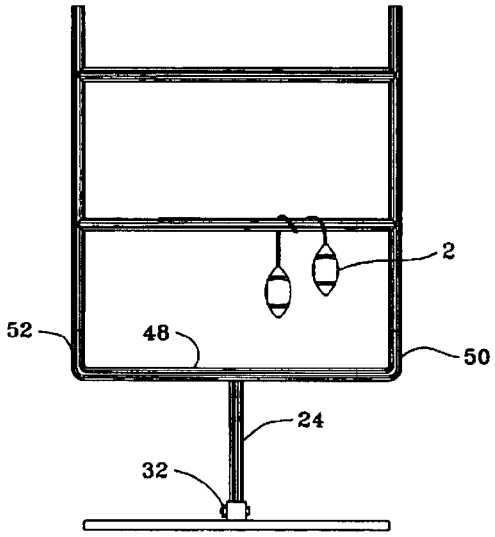
FIG. 6 is a front perspective view of a football bolo wrapped around a horizontal rung of the goalpost.
Figure 7:
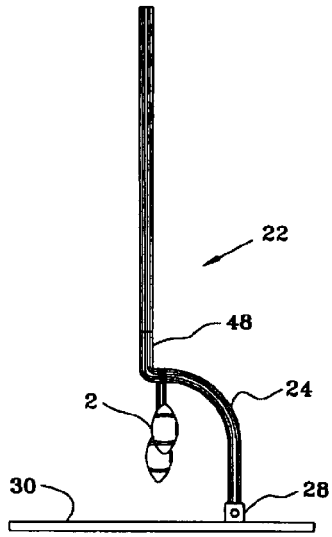
FIG. 7 is a side perspective view of the goalpost with a football bolo wrapped around the arched base support.
Figure 3:
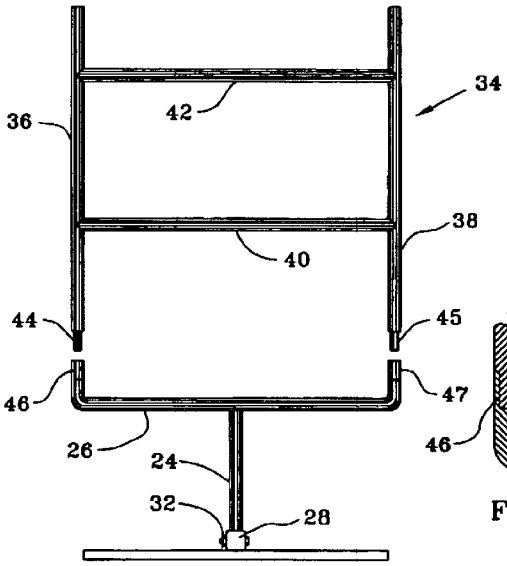
FIG. 3 is a front perspective view of a partially disassembled goal post.
Figure 5:
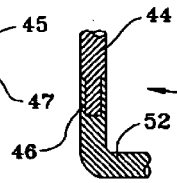
FIG. 5 is an enlarged cutaway section of the mechanical attachment between the goalpost components.
Figure 4:
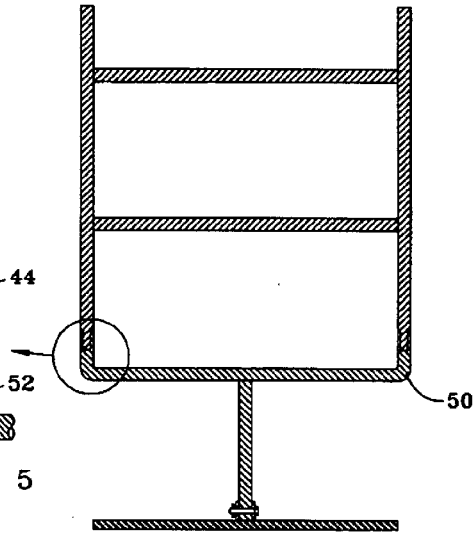
FIG. 4 is a cross sectional front view of the goal post.

Referring to FIGS. 1 and 2 it can be understood that footbolo 2 is comprised of two substantially identical miniature footballs 4 joined by a resilient tether 6 such that football ends 8 are positioned at the distal visible ends 10 of tether 6. In the preferred embodiment footballs 4 are solid bodies formed from a spongy, resilient material with laces 12 embossed on the surface, and lines 14 visually highlighted. Although not illustrated, each of the footballs 4 may bear the logo, colors, insignia or name of the user's favorite team. These will be secured with the appropriate licencing.

Tether 6 extends into cavity 16 which resides along the longitudinal axis of football 4 ending at the approximate midpoint of football 4. Glue 20 serves to mechanically affix tether 6 securely into cavity 16. Tether 6 is a rope of cotton, nylon, polyester or a similar material.

Looking at FIGS. 3 to 7, it can be seen that footbolo goalpost 22 utilizes a curved post 24 such that the side profile of goalpost 22 resembles that of a football goalpost. The bottom end of curved post 24 matingly engages retention cylinder 28 which projects normally and centrally from circular base 30. Mechanical fastener 32 affixes curved post 24 securely into cylinder 28. In the preferred embodiment mechanical fastener 32 is a bolt and wingnut although there are numerous other mechanical fastening devices well known in the art that would accomplish the same task.

Circular base 30 is fabricated from a plywood or wood product substrate although plastic or fibreboard would work equally as well. The logo, colors, insignia or name of the user's favorite team 60 will be displayed on the top side of a flexible sheet good such as cloth or plastic and will attach to base 30 by hook and loop fasteners on the bottom side of the sheet good and base 30.

The top end of curved post 24 abuts normally first horizontal bar 26 so as to form a "tee" configuration when viewed from the front perspective. The distal ends of first horizontal bar 26 are turned perpendicularly to the longitudinal axis of bar 26 and reside parallel to each other forming right connector receptacle 50 and left connector receptacle 52. Right connector receptacle 50 and left connector receptacle 52 of first horizontal bar 26 each contain left recess 46 and right recess 47.

Upright structure 34 is comprised of left upright 36 and right upright 38 positioned parallel to one another by second horizontal bar 40 and third horizontal bar 42. All bars, uprights and posts have a circular cross section. From the lower ends of left upright 36 and right upright 38 extend left peg 44 and right peg 45. These pegs matingly conform to left recess 46 and right recess 47.

When left peg 44 and right peg 45 are inserted into left recess 46 and right recess 47, and the bottom end of curved post 24 is matingly engaged into retention cylinder 28, the resulting structure forms footbolo goalpost 22. Although footbolo goalpost 22 utilizes a curved post 24 such that the side profile of goalpost 22 resembles that of a football goalpost, in an alternate embodiment curved post 24 could be replaced by an inverted "L" shaped post.

Much testing has been performed to establish the correct dimensions of and ratios between the footbolo 2 and the goalpost 22 so that the combination will enable and result in a "lively" game. Using these dimensions, when the footbolo 2 of the present invention is utilized with the game's goalpost 22, a dynamic synergism occurs wherein footbolo 22 is likely to come to rest anywhere on goalpost 22 regardless of what rung or upright it initially contacts. It is this "jumpy" nature or unpredictability of footbolo's 2 final resting place that makes this game so interesting. With the dimensions used in the preferred embodiment, the winner of the game is determined as much by luck, as by the player's skill level.

It has been determined that the length of tether 6 between the proximate ends of the miniaturized footballs is approximately twelve inches. Each miniaturized football is fifty millimeters thick (perpendicular to the longitudinal axis) and ninety millimeters long (parallel to the longitudinal axis) or as would be commonly used to denote the dimensions by one skilled in the art, 50×90 mm. The post has an overall height of three and one half feet, and a width of approximately two feet. The first horizontal bar is approximately one foot off of the base and approximately one foot from the second horizontal bar. The second horizontal bar is approximately one foot from the first and third horizontal bars. The left and right upright bars are approximately two and one half feet in length. The main arched upright positions the first horizontal bar approximately one foot off of the base. All bars are approximately three quarters of an inch in diameter. The base is circular in configuration and approximately one half to one inch thick with an approximately a one foot radius. Tether 6 has a diameter of three eights of an inch. Due to the size of footbolo 2 numerous methods of tossing are available.

In practice, two footbolo posts 22 are assembled and placed twenty five feet apart. Teams are compiled of one or two players each. The opposing teams stand to the left and right of one footbolo post 22 and take alternating turns throwing their three footbolos 2 at the other footbolo posts 22. Points are scored depending upon where the footbolos 2 finally reside. In a suggested scoring scheme, footbolos 2 wrapped around third horizontal bar 42 are worth 7 points, footbolos 2 wrapped around second horizontal bar 40 are worth 3 points and footbolos 2 wrapped around third horizontal bar 26 are worth 2 points. Footbolos 2 wrapped around other footbolos 2 cancel out each others points. Footbolos 2 wrapped around left upright 36 or right upright 38 score the points assigned to the lowest horizontal bar in that section of upright. Scoring per round is based on a net calculation of points and is done only upon completion of that entire "end". The object is to score thirty-seven points in each quarter before the opponent. If one team scores in excess of thirty-seven points then there score is returned to twenty-one points. To win, one team must win more than two quarters. In the event of a tie, with each team winning two quarters, a fifth quarter will be played.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. Examples of such modifications may be seen in the introduction of an elastic tether or in the shape and design of the tethered sport objects. A non exhaustive list of such tethered objects may include baseballs, soccer balls, golf balls, hockey pucks, etc.

Having thus described the invention, what is claimed as new and desired to be secured by Letters Patent is as follows:

1. A bolo tossing amusement device comprised of:

a plurality of the arrangements of two miniature footballs joined by a tether cord extending between one end of each football;

a miniature goalpost resembling a single support football goalpost adapted to have least two horizontal bars, a circular plywood base adapted to support said miniature goalpost; and a sheet material bearing a football team identifying emblem and adapted for attachment to said base, wherein a score is determined by the final resting positions of bolos that have been tossed so as to entwined themselves upon an upright goalpost.

2. The throwing game of skill of claim 1 wherein said tether cord is rope, said rope having a diameter between one eighth inch and one half inch.

3. The throwing game of skill of claim 1 wherein said footballs are fabricated of an elastically deformable material approximately 2 inches in width and 3.5 inches in length.

4. The throwing game of skill of claim 1 wherein said footballs are fabricated of an elastically deformable material approximately 1.5 inches wide and 2.6 inches long.

5. A tethered miniature football toss game, the combination which includes a plurality of parallel horizontal and parallel vertical bars emulating a single support football goalpost which is held generally upright by a circular base and is adapted to receive by entwinement upon said bars a thrown bolo, said bolo fashioned from two miniature sponge footballs and a flexible rope extending between one pointed end of each football.

6. The tethered miniature football toss game of claim 5 wherein said single support football goalpost is arched.

7. The tethered miniature football toss game of claim 5 wherein the number of parallel horizontal bars is three and the number of parallel vertical bars is two.

8. The tethered miniature football toss game of claim 7 further comprising a sheet good bearing a football team's identifying emblem and adapted for attachment to a top surface of said base.

9. The tethered miniature football toss game of claim 8 wherein said base and said miniature footballs bear a football team identifying emblem.

10. A throwing game of skill comprising:

at least one bolo consisting of two miniature footballs, fabricated from a spongy, foam material tethered apart by a flexible resilient cord;

a mechanical fastener;

a goalpost emulating a football goalpost wherein said goalpost is formed from a pair of round, vertical bars held in parallel and angular alignment by a pair of round, parallel, horizontal bars mechanically affixed normal to said vertical bars, said vertical bars having a peg extending therefrom, and a curved vertical support post adapted to receive said mechanical fastener and projecting normally from the approximate midpoint of a horizontal bar, said horizontal bar having distal ends with cylindrical cavities projecting vertically upwards and adapted for receiving said pegs; and a circular base having a central cylinder projecting normally from said base adapted to receive said curved support post and said mechanical fastener, wherein points of this game are determined by the final resting positions of bolos that have been tossed so as to ensnare themselves on the bars of the goalpost.

11. The throwing game of skill of claim 10 further comprising a fabric bearing a football team identifying emblem and adapted for attachment to said base.

12. The throwing game of skill of claim 11 wherein said cord is a polyester rope, and when full extended, separates said miniature footballs by approximately one foot.

13. The throwing game of skill of claim 12 wherein said round, vertical bars are approximately 2.5 feet high.

14. The throwing game of skill of claim 13 wherein said horizontal bars are approximately 2 feet long.

15. The throwing game of skill of claim 14 wherein said round, parallel, horizontal bars are mechanically affixed normal to said vertical bars at positions approximately 1 foot and 2 feet from a bottom end of said vertical bars.

16. The throwing game of skill of claim 15 wherein said mechanical fastener is a bolt and wingnut and said base and said curved support post define orifices that matingly align to receive said fastener.

17. The throwing game of skill of claim 16 wherein said base is formed from plywood and is approximately two feet in diameter.

18. The throwing game of skill of claim 17 wherein the number of bolos is six.

19. The throwing game of skill of claim 18 wherein said miniature footballs are approximately 50 mm wide and 90 mm long.

20. The throwing game of skill of claim 18 wherein said miniature footballs are approximately 40 mm wide and 66 mm long.

* * * * *